US011759718B2

(12) United States Patent
Bagumyan et al.

(10) Patent No.: US 11,759,718 B2
(45) Date of Patent: Sep. 19, 2023

(54) BAFFLE CONSTRUCTION FOR INFLATABLE STRUCTURE

(71) Applicants: Sarmen Bagumyan, Sun Valley, CA (US); Arthur Bagumyan, Sun Valley, CA (US); Andranik Andy Bagumyan, Sun Valley, CA (US)

(72) Inventors: Sarmen Bagumyan, Sun Valley, CA (US); Arthur Bagumyan, Sun Valley, CA (US); Andranik Andy Bagumyan, Sun Valley, CA (US)

( * ) Notice: Subject to any disclaimer, the term of this patent is extended or adjusted under 35 U.S.C. 154(b) by 475 days.

(21) Appl. No.: 17/169,717

(22) Filed: Feb. 8, 2021

(65) Prior Publication Data

US 2022/0249962 A1 Aug. 11, 2022

(51) Int. Cl.
*A63G 21/02* (2006.01)

(52) U.S. Cl.
CPC ..... *A63G 21/02* (2013.01)

(58) Field of Classification Search
CPC ..... A63G 21/02; A63G 31/12; A63G 21/00; A63G 21/18; A63G 31/00
See application file for complete search history.

(56) References Cited

U.S. PATENT DOCUMENTS 2,343,313 A * 3/1944 Maynes ..... A63G 3/02 104/73
5,636,478 A * 6/1997 Chen ..... E04H 15/324 135/96
6,558,264 B2 * 5/2003 Gordon ..... A63G 21/18 472/117
6,568,011 B2 5/2003 Fisher et al.
7,210,976 B2 * 5/2007 Gordon ..... B63B 34/52 472/117
7,682,260 B1 * 3/2010 Whitlock ..... A63G 31/12 472/117
8,769,880 B2 * 7/2014 Mouyiaris ..... E02B 3/108 52/79.5
10,071,318 B1 * 9/2018 Bagumyan ..... A63G 31/12
10,131,092 B1 11/2018 Cook et al.
2002/0023390 A1 * 2/2002 Nagle ..... E04H 15/20 52/2.18
2003/0027645 A1 * 2/2003 Gordon ..... A63G 21/18 472/117

(Continued)

FOREIGN PATENT DOCUMENTS

EP 2249684 6/2013

*Primary Examiner* — Brian E Glessner
*Assistant Examiner* — Adam G Barlow
(74) *Attorney, Agent, or Firm* — Eric Karich; Karich & Associates

(57) ABSTRACT

An inflatable structure has a top wall, a bottom wall vertically spaced from the top wall, and a vertical baffle having a top edge connected to the top wall, and a bottom edge connected to the bottom wall. A pair of top diagonal support baffles connect the vertical baffle to the top wall, each of the pair of top diagonal support baffles being connected to the top wall on opposite sides of a top edge of the vertical baffle, and spaced a distance from the top edge of the vertical baffle. A pair of bottom diagonal support baffles further connect the vertical baffle to the bottom wall, each of the pair of bottom diagonal support baffles being connected to the bottom wall on opposite sides of bottom edge of the vertical baffle, and spaced a distance from the bottom edge of the vertical baffle.

6 Claims, 5 Drawing Sheets

(56) References Cited

U.S. PATENT DOCUMENTS

| | | | | |
|---|---|---|---|---|
| 2005/0245354 | A1* | 11/2005 | Shaljyan | A63G 31/12 482/35 |
| 2007/0072690 | A1* | 3/2007 | Berenson | A63G 31/12 472/117 |
| 2007/0167246 | A1* | 7/2007 | McKee | A63G 21/00 472/116 |
| 2009/0137330 | A1* | 5/2009 | Sefchick | A63G 31/007 472/117 |
| 2009/0149111 | A1* | 6/2009 | Scherba | A63G 9/00 446/478 |
| 2019/0046887 | A1* | 2/2019 | Vicente | A63G 31/007 |

* cited by examiner

BAFFLE CONSTRUCTION FOR INFLATABLE STRUCTURE

BACKGROUND OF THE INVENTION

Field of the Invention

This invention relates generally to inflatable structures, and more particularly to an inflatable structure that includes a baffle construction that is lighter and uses less material.

Description of Related Art

Standard inflatable structures, such as inflatable slides and similar structure, are well known in the art. Gordon, U.S. Pat. No. 6,558,264, for example, teaches an inflatable water slide that includes an inflatable wedge for children to slide down.

These inflatable structures typically include a plurality of baffles to provide support to the structure. In particular, these structures usually include a plurality of vertical walls for providing vertical support. Fisher, U.S. Pat. No. 6,568,011, for example, teaches an inflatable mattress which includes top and bottom layers that are connected by vertical baffle walls.

Cook, U.S. Pat. No. 10,131,092, teaches an inflatable structure wherein the baffle is connected to the outer skin of the inflatable structure with a T-shaped connector. A middle section of the connector is fused to the facing surface of the panel wall.

The prior art teaches a plurality of vertical baffles that are directly connected to top and bottom walls of the inflatable structure to provide vertical support to an inflatable structure. However, the prior art does not teach a vertical baffle connected to both the top and bottom walls of the inflatable structure, which also includes diagonal support baffles connecting the vertical baffle to the top and bottom walls of the inflatable structure, connected on either side of the vertical baffle. The present invention fulfills these needs and provides further advantages as described in the following summary.

SUMMARY OF THE INVENTION

The present invention teaches certain benefits in construction and use which give rise to the objectives described below.

The present invention provides an inflatable structure that comprises a top wall, a bottom wall vertically spaced from the top wall, and a vertical baffle having a top edge connected to the top wall, and a bottom edge connected to the bottom wall. A pair of top diagonal support baffles connect the vertical baffle to the top wall, each of the pair of top diagonal support baffles being connected to the top wall on opposite sides of a top edge of the vertical baffle, and spaced a distance from the top edge of the vertical baffle. A pair of bottom diagonal support baffles further connect the vertical baffle to the bottom wall, each of the pair of bottom diagonal support baffles being connected to the bottom wall on opposite sides of bottom edge of the vertical baffle, and spaced a distance from the bottom edge of the vertical baffle.

A primary objective of the present invention is to provide an inflatable structure having advantages not taught by the prior art.

Another objective is to provide an inflatable structure having three laterally spaced points of support with only a single vertical baffle, which significantly reduces the weight of the inflatable structure.

A further objective is to provide an inflatable structure that uses less material than standard prior art structures.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an inflatable structure that includes a baffle construction that is lighter and uses less material. The internal baffle structure of the present invention provides three points of support with only a single vertical baffle. By enabling the removal of two of the three vertical baffles, the bulk and weight of the inflatable structure is significantly reduced without a loss of support and structural integrity.

Figure 1:
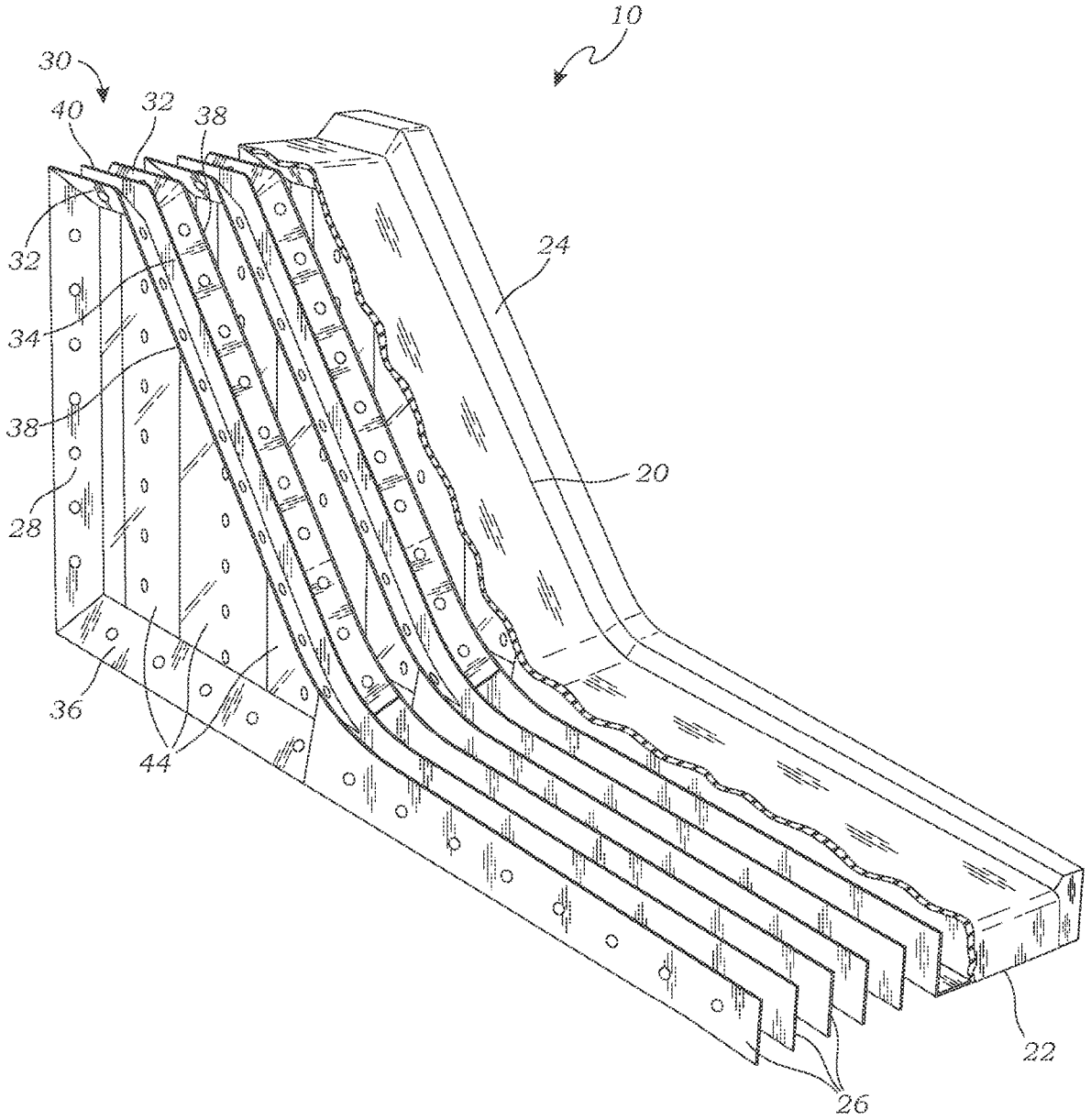
FIG. 1 is a perspective view of an inflatable structure according to one embodiment of the present invention, a portion of a top wall of the inflatable structure being shown broken away to illustrate internal baffle structures of the inflatable structure.

FIG. 1 is a perspective view of an inflatable structure 10 according to one embodiment of the present invention. For clarity, a portion of a top wall 20 of the inflatable structure 10 being shown broken away to illustrate internal baffle structures 30 of the inflatable structure 10.

As shown in FIG. 1, the inflatable structure 10 includes at least one (in this case three) of the internal baffle structures 30, which are described in greater detail below. While this is one embodiment of this invention, any number of the internal baffle structures 30 may be used.

Furthermore, while this is illustrated in a slide, any form of inflatable structure may include this internal baffle structure 30, and any construction known in the art should be considered within the scope of the present invention.

In the embodiment of FIG. 1, the inflatable structure 10 includes the top wall 20 and a bottom wall 22 vertically spaced from the top wall 20 by the internal baffle structures 30. The top wall 20 is attached to a top pair of diagonal baffles 32, which are spaced a lateral width from a vertical baffle 34, which may be at the approximate midpoint. Similarly, the bottom wall 22 extends a lateral width across a bottom pair of diagonal baffles 36. These constructions are described in greater detail below, and illustrated in some of the following figures.

In this embodiment, the top and bottom walls 20 and 22 are in the form of an inflatable slide having a side bumper 24, which may be supported by additional structures, as is well-known in the art. Further, the top and bottom walls 20 and 22 may each extend a longitudinal length past the top and bottom diagonal baffles 32 and 36, respectively, and into parallel supports 26 that terminate the inflatable slide. In this embodiment, two of the parallel supports 26 extend from an outer edge 38 of each of the top and bottom diagonal baffles 32 and 36, and one of the parallel supports 26 extends from the vertical baffle 34. The parallel supports 26 may be integrally formed with the internal baffle structure(s) 30, or they may be attached via any means known in the art (e.g., sewn, welded, etc.). As noted above, each of the internal baffle structures 30 of the present invention provides three laterally spaced points of support with only a single vertical baffle 34, which significantly reduces the weight of the inflatable structure 10. In some embodiments, the internal baffle structure 30 may further include a pair of rear diagonal baffles 28, discussed in greater detail below.

While illustrated as part of an inflatable slide, the inflatable structure 10 of this invention and its construction process and methods may be incorporated into the design and construction of any inflatable structure (e.g., a mattress, obstacle course, pool toy, etc.). The top wall 20 and the bottom wall 22 may each be constructed of sheets of thermo-plastic covered fabrics of the type typically used in inflatable structures, such as PVC coated woven nylon cloth, or any other suitable materials for an inflatable structure. The top wall 20, the bottom wall 22, and/or the side bumper 24 may be sewn and/or welded together, or may be otherwise attached directly to the inflatable structure 10 using any method known in the art. The inflatable structure 10, including the fabric portions, may be assembled via stitching, a hot-air fusing process, or any other suitable means of construction known to those skilled in the art. Further details of the internal baffle structure 30 and its construction are shown in the following figures and described below.

Figure 2:
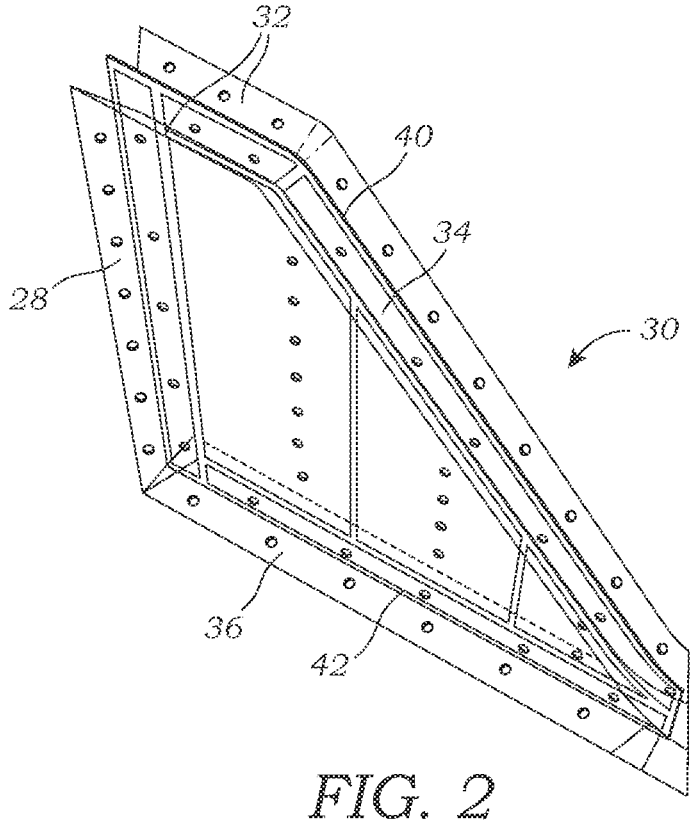
FIG. 2 is a perspective view of one of the internal baffle structures, in a fully assembled configuration, the internal baffle structure including a vertical baffle and top and bottom pairs of diagonal baffles.
Figure 3:
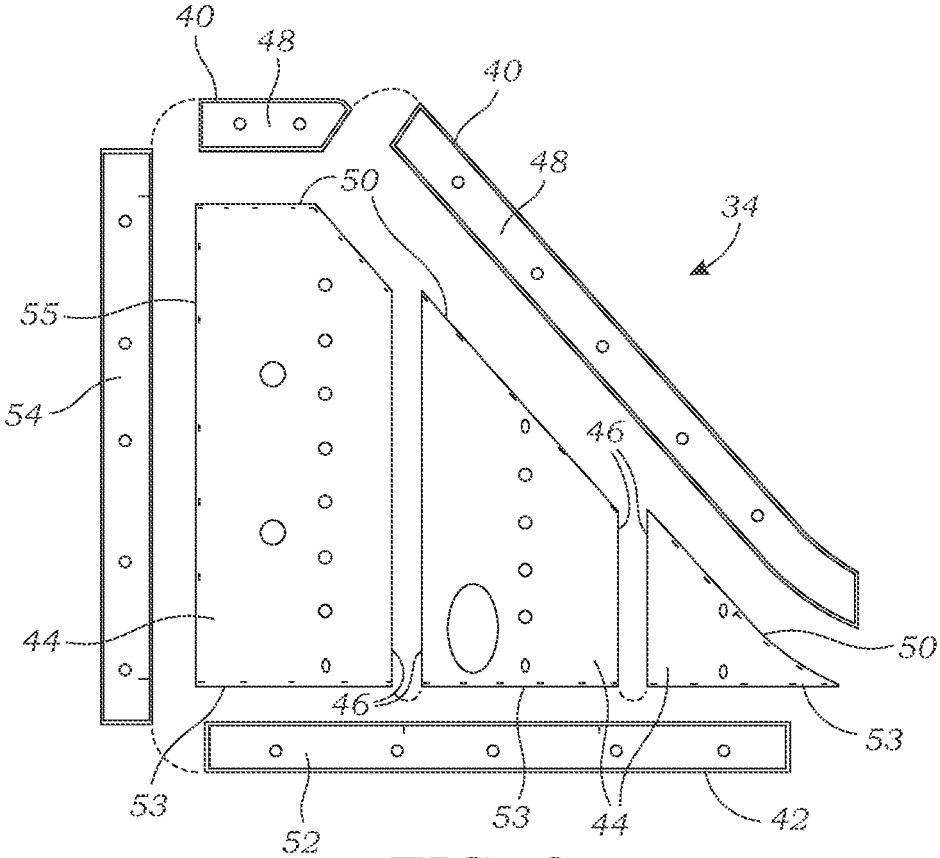
FIG. 3 is an exploded side elevation view of one embodiment of the vertical baffle.
Figure 4:
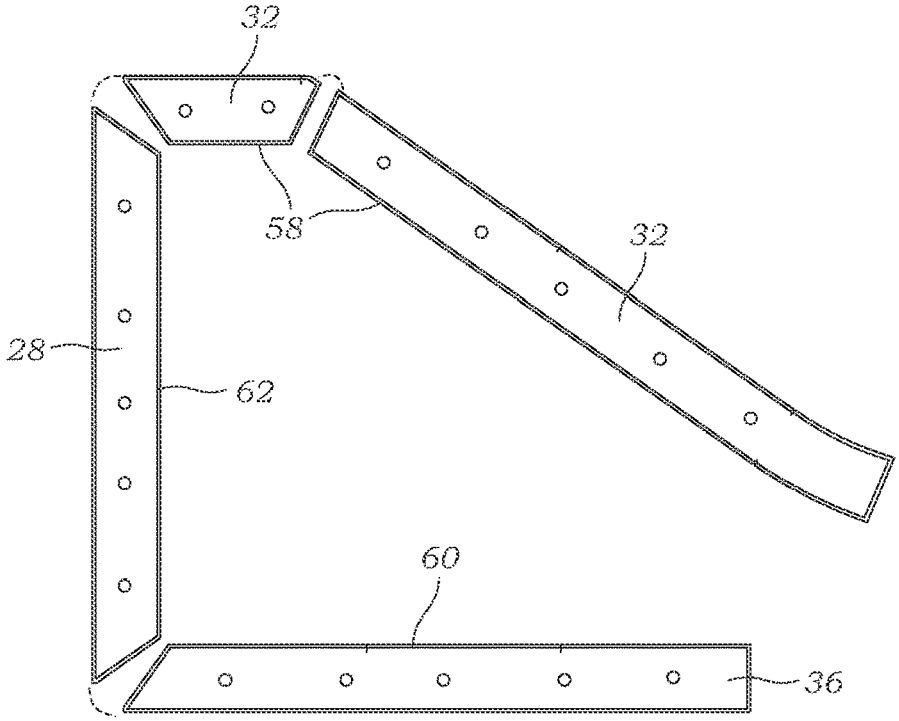
FIG. 4 is an exploded side elevation view of one embodiment of the diagonal baffles.

FIG. 2 is a perspective view of one of the internal baffle structures 30, in a fully assembled configuration. FIG. 3 is an exploded side elevational view of one embodiment of the vertical baffle 34. FIG. 4 is an exploded side elevational view of one embodiment of one side of the diagonal baffles 32, 36, and 28.

As shown in FIGS. 2-4, the internal baffle structure 30 including the vertical baffle 34 (also shown by itself in FIG. 3) and the top and bottom pairs of diagonal baffles 32 and 36 (also shown by itself in FIG. 4). As shown in FIG. 2-4, the internal baffle structure 30 includes the vertical baffle 34, which has a top edge 40 connected to the top wall 20, and a bottom edge 42 connected to the bottom wall 22. The pair of top diagonal support baffles 32 connect the vertical baffle 34 to the top wall 20, each of the pair of top diagonal support baffles 32 being connected to the top wall 20 on opposite sides of the top edge 40 of the vertical baffle 34, and spaced a distance from the top edge 40 of the vertical baffle 34 (best shown in FIG. 4). Furthermore, the pair of bottom diagonal support baffles 36 connect the vertical baffle 34 to the bottom wall 22, each of the pair of bottom diagonal support baffles 36 being connected to the bottom wall 22 on opposite sides of the bottom edge 42 of the vertical baffle 34, and spaced a distance from the bottom edge 42 of the vertical baffle 34.

As shown in FIG. 3, in this embodiment, the vertical baffle 34 comprises a plurality of panels 44 that are connected to each other at side edges 46, a top band 48 that is connected to top portion 50 of at least some of the plurality of panels 44, and a bottom band 52 that is connected to bottom portions 53 of all of the plurality of panels 44. In this embodiment, the top band 48 is provided in two pieces, and a rear band 54 is also connected to a rear edge 55 of the plurality of panels 44, and may further be connected to the top band 48 and the bottom band 52. While one particular construction of the vertical baffle 34 is shown, the vertical baffle 34 may also be constructed of a single piece, or be constructed of a different number and/or ratio/shape of components than is shown in FIG. 3.

As shown in FIG. 4, this may include one of the top diagonal baffles 32, one of the bottom diagonal baffles 36, and one of the rear diagonal baffles 28, wherein the top diagonal baffle 32 and the bottom diagonal baffle 36 are each connected to the rear diagonal baffle 28 at side edges 56. Similar to the discussion of FIG. 3, the top diagonal baffles 32 may each be constructed in two pieces. The assemblies shown in FIGS. 3-4 may be attached via stitching, a hot-air fusing process, welding, bolts, or any other suitable means of construction known to those skilled in the art.

Figure 5:
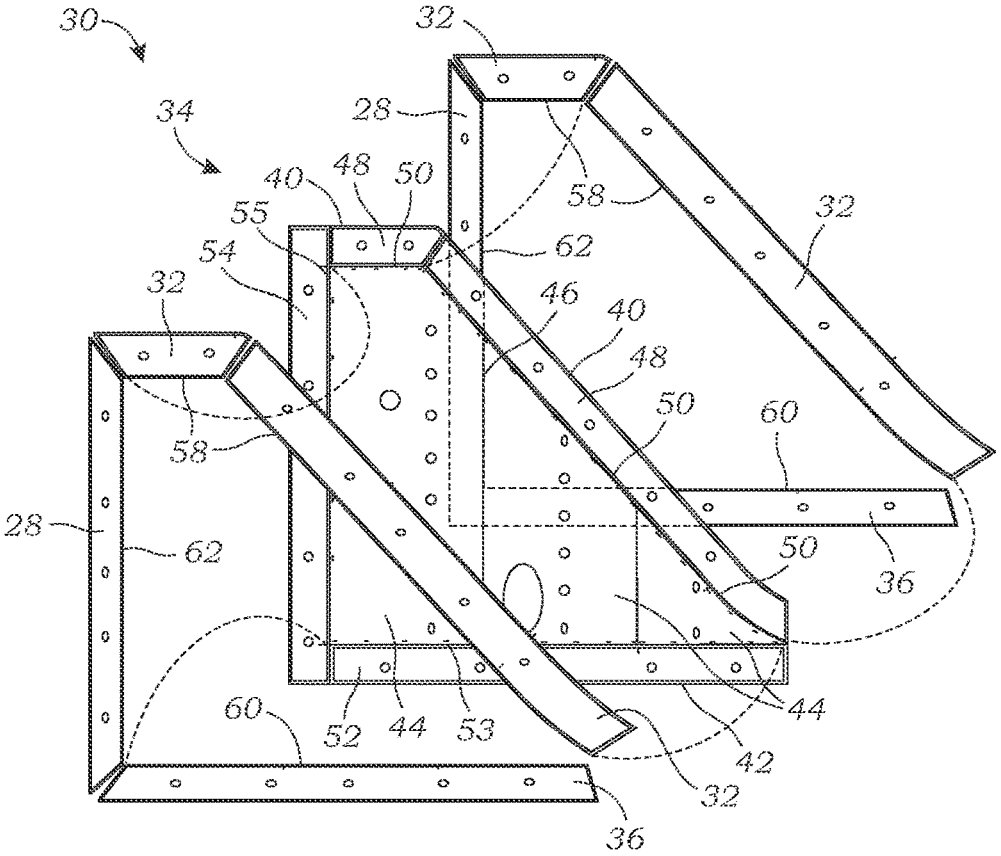
FIG. 5 is an exploded perspective view of the vertical baffle of FIG. 3 and the diagonal baffles of FIG. 4.

FIG. 5 is an exploded perspective view of the vertical baffle 34 of FIG. 3 and the diagonal baffles 32, 36, and 28 of FIG. 4. As shown in FIG. 5, as discussed above the components of the internal baffle structure 30 may be connected together via any means devised by those skilled in the art. The top band 48 of the vertical baffle 34 is aligned between the top diagonal baffles 32 and secured together, the bottom band 52 of the vertical baffle 34 is aligned between the bottom diagonal baffles 36 and secured together, and the rear band 54 is further secured between the rear diagonal baffles 28. In this embodiment, and as shown in FIG. 6, the top and bottom diagonal baffles 32 and 36 may have lower and upper edges 58 and 60, respectively, which are attached to the vertical baffle 34, and the rear diagonal support baffles 36 may further have an inner edge 62 attached to the vertical baffle 34.

Figure 6:
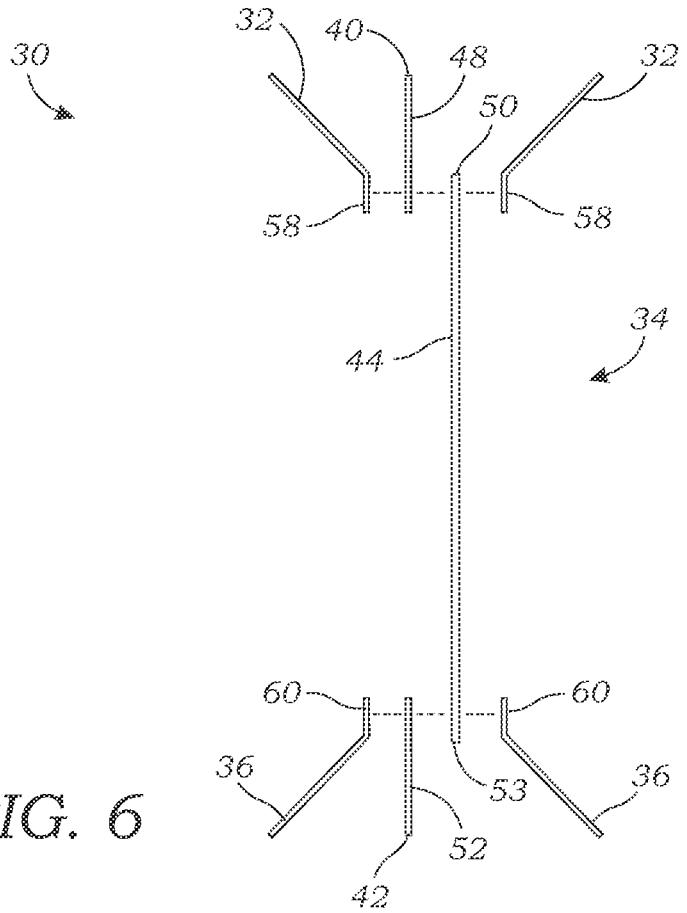
FIG. 6 is an exploded front elevation view of the vertical baffle, illustrating how the diagonal baffles are attached.

FIG. 6 is an exploded front elevational view of the vertical baffle 34, illustrating how the diagonal baffles 32 and 36 are attached. As discussed above, each of the top diagonal support baffles 32 may have the lower edge 58 that is attached to the top band 48 of the vertical baffle 34, wherein the pair of top diagonal support baffles 32 extend diagonally outwardly from the lower edge 58 and the top band 48 a distance that is suitable for supporting the top wall.

Each of the pair of bottom diagonal support baffles 36 may also have the upper edge 60 attached to the bottom band 52 of the vertical baffle 34, and the rear diagonal support baffles 28 may further have the inner edge 62 attached to the rear edge 55 of the rear band 54 of the vertical baffle 34 (shown in FIG. 5). As shown in FIG. 6, in this embodiment, the top and bottom pairs of diagonal baffles 32 and 36, and the top and bottom bands 48 and 52 of the vertical baffle 34 sandwich the top and bottom portions 50 and 53 of the plurality of panels 44 therebetween when secured together.

Figure 7:
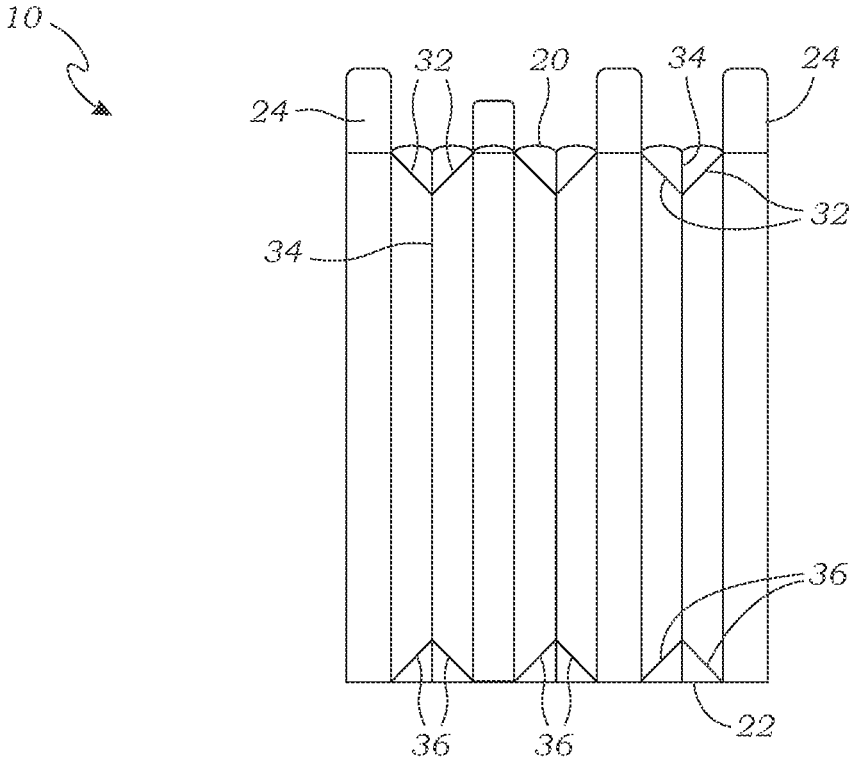
FIG. 7 is a rear elevation cross-sectional view of one embodiment of the inflatable structure having the internal baffle structure of FIG. 2.

FIG. 7 is a rear elevational cross-sectional view of one embodiment of the inflatable structure 10 having the internal baffle structure 30 of FIG. 2. As shown in FIG. 7, the inflatable structure 10 in a fully constructed configuration may be embodied as three adjacent inflatable slides, each having the top wall 20 and the bottom wall 22 for inflating atop the internal baffle structures 30.

Figure 8:
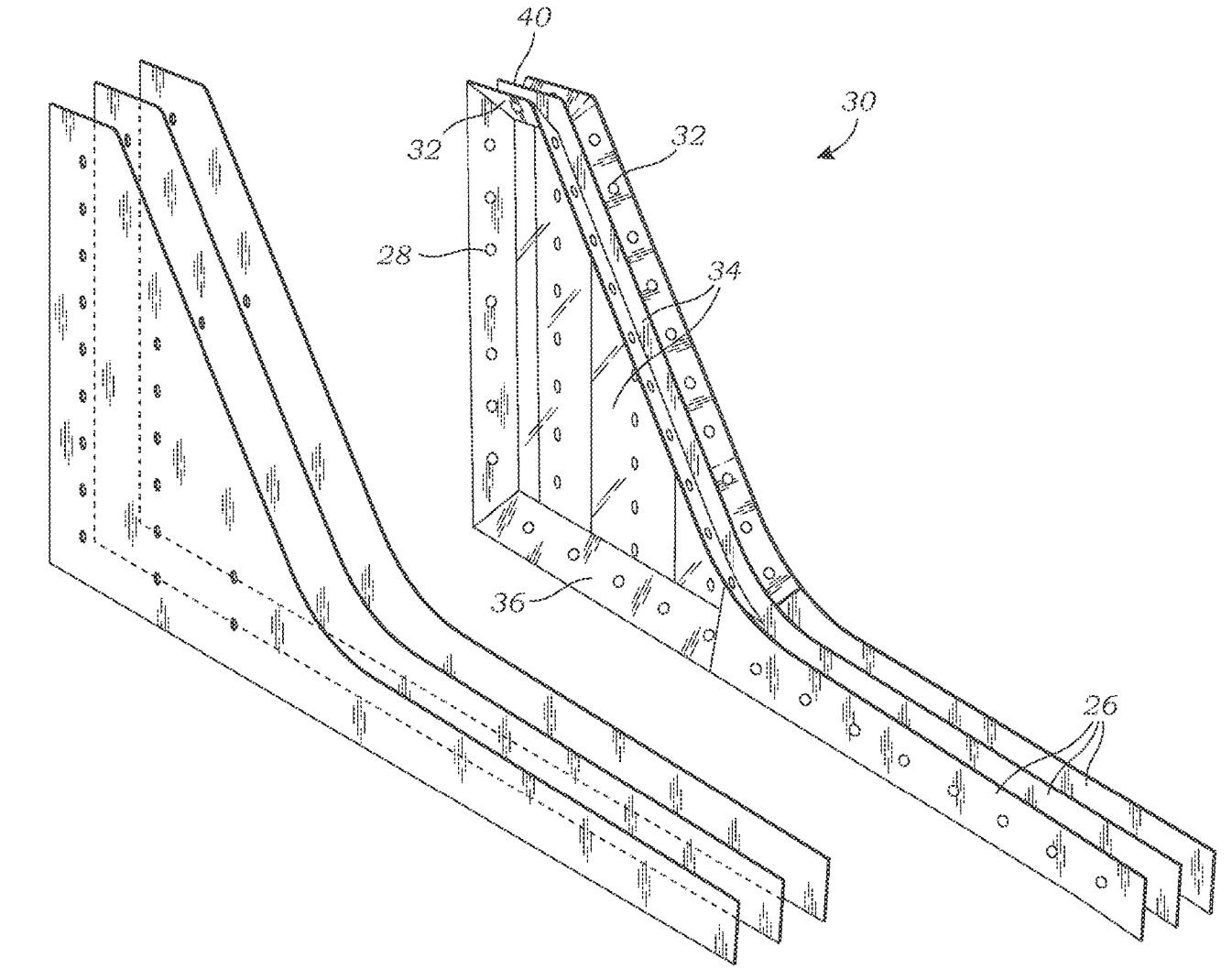
FIG. 8 is a side by side comparison of the internal baffle structure of FIG. 2 and a prior art baffle structure.

FIG. 8 is a side by side comparison of the internal baffle structure 30 of FIG. 2 and a prior art baffle structure (shown on the left of the structure 30 for comparison). As shown in FIG. 8, typical prior art baffle structures comprise multiple vertical baffles that extend to the parallel supports from the discussion of FIG. 1, making the entire internal baffle structure bulky and heavy. However, the present invention includes the diagonal baffles 32, 36, and 28 that are connected to a single baffle, which provides equivalent vertical support while significantly reducing the amount of material used to create three points of support for the top and bottom walls 20 and 22 (shown in FIGS. 1-2 and 7) without compromising structural integrity.

The prior art teaches a plurality of vertical baffles that are directly connected to top and bottom walls of the inflatable structure to provide vertical support to an inflatable structure. However, the prior art does not teach a vertical baffle connected to both the top and bottom walls of the inflatable structure, which also includes diagonal support baffles connecting the vertical baffle to the top and bottom walls of the inflatable structure, connected on either side of the vertical baffle.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An inflatable structure comprising:

a top wall;

a bottom wall vertically spaced from the top wall;

a vertical baffle having a top edge connected to the top wall, and a bottom edge connected to the bottom wall;

a pair of top diagonal support baffles connecting the vertical baffle to the top wall, each of the pair of top diagonal support baffles being connected to the top wall on opposite sides of a top edge of the vertical baffle, and spaced a distance from the top edge of the vertical baffle; and a pair of bottom diagonal support baffles connecting the vertical baffle to the bottom wall, each of the pair of bottom diagonal support baffles being connected to the bottom wall on opposite sides of bottom edge of the vertical baffle, and spaced a distance from the bottom edge of the vertical baffle.

2. The inflatable structure of claim 1, wherein the vertical baffle comprises a plurality of panels that are connected to each other at side edges, a top band that is connected to top edges of all of the plurality of panels, and a bottom band that is connected to bottom edges of all of the plurality of panels.

3. The inflatable structure of claim 2, wherein each side of the vertical baffle has mounted thereupon one of the top diagonal support baffles, one of the bottom diagonal support baffles, and one of a pair of rear diagonal support baffles, wherein the top diagonal baffle and the bottom diagonal baffle are each connected to the rear diagonal baffle at side edges.

4. The inflatable structure of claim 3, wherein each of the top diagonal support baffles has a lower edge that is attached to the top band of the vertical baffle, wherein the top diagonal support baffles extend outwardly from the vertical baffle a distance that is suitable for supporting the top wall.

5. The inflatable structure of claim 1, wherein the vertical baffle is attached to the top and bottom diagonal support baffles via welding.

6. The inflatable structure of claim 1, wherein the vertical baffle is attached to the top and bottom diagonal support baffles via stitching.

* * * * *